United States Patent [19]

Grabathy

[11] 4,034,435

[45] July 12, 1977

[54] VACUUM CLEANER ACCESSORY

[76] Inventor: Jeannette Grabathy, 12151 Salerno St., Garden Grove, Calif. 92846

[21] Appl. No.: 698,267

[22] Filed: June 21, 1976

[51] Int. Cl.[2] ..... A47L 9/06

[52] U.S. Cl. ..... 15/398; 15/416; 15/419

[58] Field of Search ..... 15/398, 399, 400, 415, 15/416, 419

[56] References Cited

U.S. PATENT DOCUMENTS

| | | | |
|---|---|---|---|
| 2,534,189 | 12/1950 | Wright | 15/415 |
| 2,562,167 | 7/1951 | Bilde | 15/398 X |
| 2,827,060 | 3/1958 | Marty | 15/400 X |
| 2,866,221 | 12/1958 | Warva | 15/400 X |

FOREIGN PATENT DOCUMENTS

| | | | |
|---|---|---|---|
| 158,221 | 1/1933 | Switzerland | 15/415 |

*Primary Examiner*—Christopher K. Moore

[57] ABSTRACT

A ported brush supporting vacuum cleaner accessory capable of being removably mounted on the free end of a pliable hose in which a negative pressure is maintained. The brushes of the accessory are mounted on resilient tabs that normally close a number of spaced ports formed in the accessory. The brushes serve a two-fold purpose; first, when brought into rubbing contact with a surface they tend to dislodge dirt and dust therefrom, and second, the pressure contact of a brush with the surface results in the tab with which the brush is associated being temporarily moved to a second position. A tab when in a second position allows a stream of air at high velocity to flow through the port with which it is associated from the ambient atmosphere to the interior of the accessory. Each such streams of air carries dirt or dust dislodged from the surface into the interior of the accessory. The brushes when removed from pressure contact with a surface allow the tabs to return to first positions where they seal the ports with which they are associated.

2 Claims, 4 Drawing Figures

FIG. 1
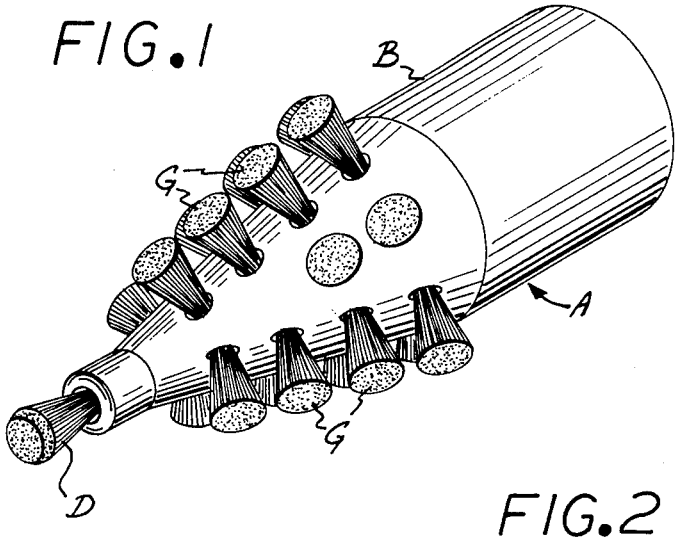
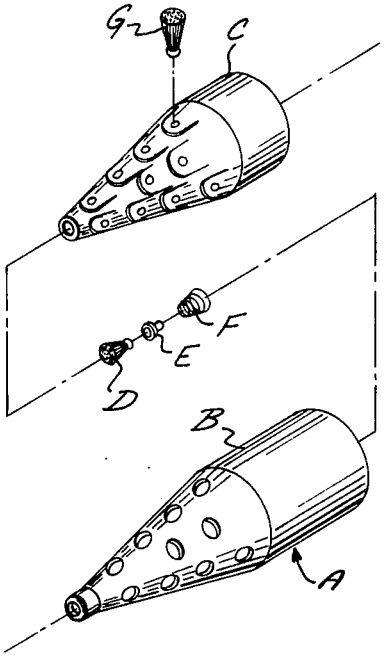
FIG. 2
FIG. 3
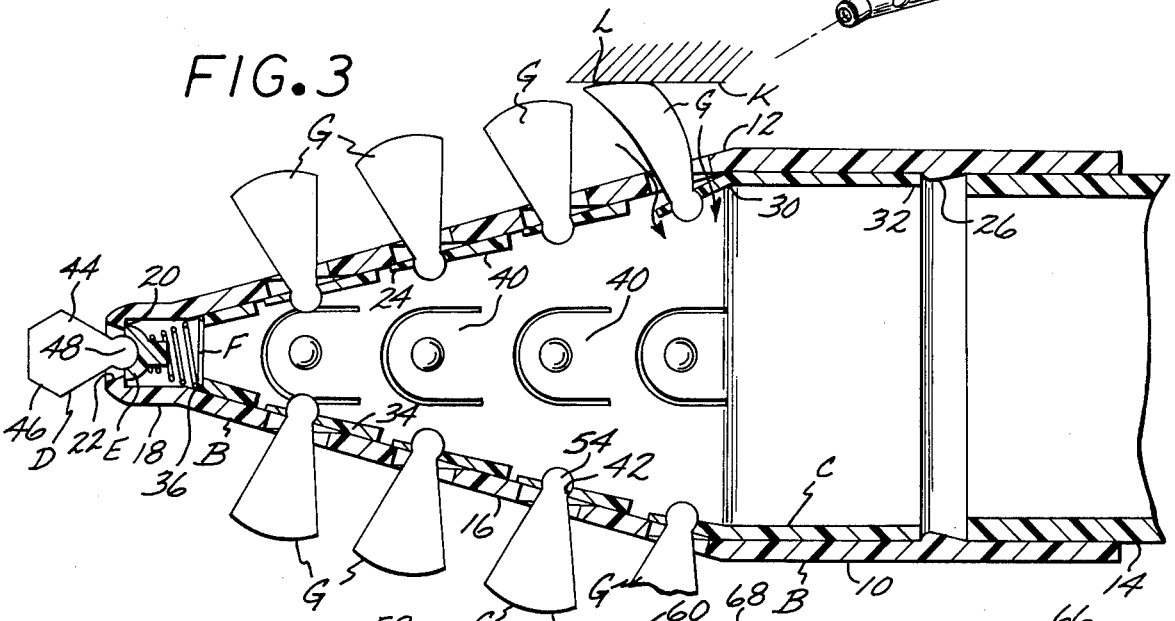
FIG. 4
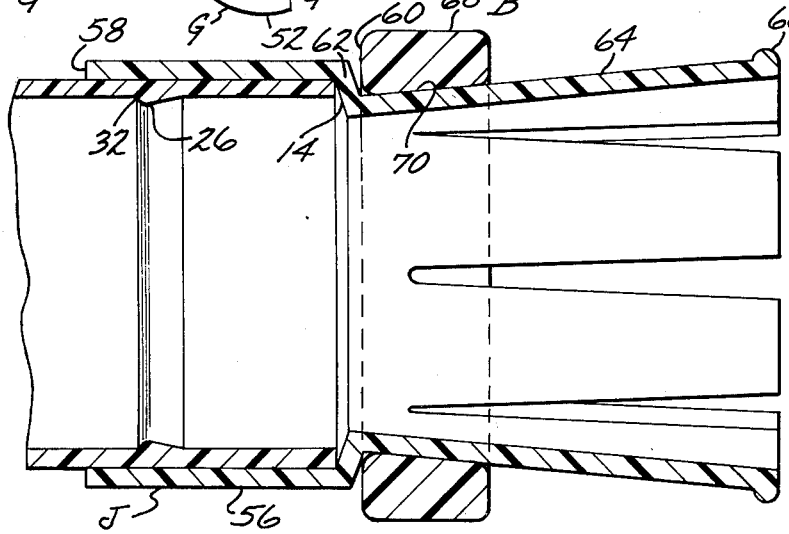

VACUUM CLEANER ACCESSORY

BACKGROUND OF THE INVENTION

1. Field of the Invention

Vacuum cleaner accessory.

2. Description of the Prior Art

Present day vacuum cleaners have heads mounted on the free ends of the pliable hose. Such heads have relatively large openings therein through which a stream of air is drawn at a sufficient velocity to pick up dust, dirt and foreign material that has little tendency to cling to the surface on which it is deposited. Heads of the type above-identified are normally of substantial size and to a degree that they cannot be manipulated into corners or other restricted spaces.

A primary object in devising the present invention is to provide a small compact accessory that may be removably mounted on the free end of a pliable vacuum cleaner hose to remove dust or dirt from a surface by first subjecting the dust or dirt to the rubbing action of one or more brushes to dislodge the dust or dirt, and then retrieving the dislodged dust or dirt by one or more streams of air that move inwardly into the accessory at a far higher velocity than that attainable in present-day vacuum cleaner heads.

Another object of the accessory is to provide one that supports a number of circumferentially and longitudinally spaced brushes that serve the dual function of removing dirt and dust from a surface when brought into pressure rubbing contact therewith, and the brushes that subject the surface to pressure also selectively opening a portion of the ports in the accessory to permit streams of air at high velocity to flow into the accessory to retrieve the dislodged dust or dirt.

SUMMARY OF THE INVENTION

The present invention is removably mountable on the free end of a pliable vacuum cleaner hose in which a negative pressure is maintained, with the invention, when so mounted, capable of being used to loosen dust or dirt from a surface, and then retrieve the loosened dust or dirt by one or more streams of air that move at a high velocity.

The invention includes a first housing that has a first cylindrical shell that has first and second ends. The first end of the shell develops into a first conical shell that has an apex in which a first port is defined. The first shell has a number of circumferentially and longitudinally spaced second ports formed therein, with the first cylindrical shell having a transverse circumferential resilient rib extending inwardly from the interior surface thereof. The rib is situated intermediate the first and second ends of the first cylindrical shell.

A second housing is provided that is preferably molded from a resilient polymerized resin, with the second housing including a second cylindrical shell that has first and second ends. The first end of the second shell developed into a conical shell that has a truncated apex portion. The second conical shell has a number of circumferentially and longitudinally spaced U-shaped slits formed therein, which slits define resilient tabs within the confines thereof. The tabs are of greater area than that of the areas of the second ports. The second housing is of such dimension as to fit snugly within the interior of the first housing and being held in a fixed position within the first housing by the rib engaging the first end of the second shell. The tabs are radially aligned with the second port in the first conical shell, and seal these ports when the tabs are in first positions.

A spring-loaded sealing member is disposed between the apex portions of the first and second conical shell, and the sealing member at all times tending to assume a first position where it seals the first port in the first conical shell.

A first brush is secured to the sealing member, which first brush extends outwardly through the first port. A number of second brushes are secured to the tabs and extend outwardly through the second ports. The first and second brushes are sufficiently stiff as to move the spring-loaded sealing member and the tabs with which they are associated to second positions when the first and second brushes are brought into pressure rubbing contact with a surface on which dust or dirt may exist. This rubbing contact tends to loosen dust or dirt, and the sealing member and tab when the first and second brushes move them to second positions allowing streams of high velocity air to flow from the ambient atmosphere into the interior of the second housing, and these streams of air carrying dust or dirt that has been loosened into the interior of the second housing or subsequent transfer through the hose to the vacuum cleaner. The brushes, upon being removed from contact with the surface that has dust or dirt thereon, allow the spring-loaded sealing member and the tabs that were in second positions to move to first positions where the first and second ports are closed. The components comprising invention are of such shape and configuration that they are ideally suited for being injection molded from a suitable polymerized resin.

BRIEF DESCRIPTION OF THE DRAWING

FIG. 1 is a perspective view of the vacuum cleaner accessory;

FIG. 2 is an exploded perspective view of the components comprising the accessory shown in FIG. 1;

FIG. 3 is a longitudinal cross-sectional view of the accessory, with one of the brushes being illustrated as being in pressure rubbing contact with the surface on which dirt or dust may exist; and FIG. 4 is a longitudinal cross-sectional view of an adjustable mounting adaptor that permits the invention to be removably secured to the free end of a pliable vacuum cleaner hose.

DESCRIPTION OF THE PREFERRED EMBODIMENT

The vacuum cleaner accessory A as shown in FIG. 1, includes a number of components that are illustrated in an exploded perspective in FIG. 2. The major components of the invention A are a first outer housing B that has a second inner housing C disposed therein. A first tip brush D is provided that is supported in a holder E that is in contact with a helical spring F. A number of second brushes G are provided, which occupy the positions shown in FIGS. 1 and 3 when the components of the vacuum cleaner accessor A are assembled.

The first outer housing B, that is preferably injection moulded from a suitable polymerized resin, includes a first cylindrical shell 10 that has a first end 12 and second end 14. The first end 12 of shell 10 develops into a first conical shell 16, which conical shell at the apex thereof develops into a short tube 18 having an inwardly extending lip 20 on the free end thereof. The tube 18 serves to define first port 22. The first conical shell 16 has a number of circumferentially and longitudinally spaced second ports 24 formed therein as best seen in FIG. 1. The first cylindrical shell 10 has a rib 26 that extends inwardly from the interior surface thereof, with the rib being located intermediate the first and second ends 12 and 14 of the first cylindrical shell 10.

The second housing C is of such size and configuration as to be snugly mountable within the interior of the first housing B as shown in FIG. 3. The second housing C includes a second cylindrical shell 28 that has a first end 30 and second end 32. The first end 30 of second cylindrical shell 28 develops into a second conical shell 34 that terminates in a truncated apex 36. The second conical shell 34 has a number of circumferentially and longitudinally spaced U-shaped slits 38 defined therein, which slits within the interior thereof provide a number of resilient tabs 40. Each of the tabs 40 has an aperture formed therein. When the second housing C is fully positioned within the confines of the first housing B, the rib 26 engages the second ends 32 of second shell 28 to hold a second housing C in a fixed position in the first housing. The tabs 40 are radially aligned with the second ports 24 as shown in FIG. 3.

The first brush D, as best seen in FIG. 3, includes a first body of bristles 44 that are disposed side-by-side, with the bristles having free ends 46, and second ends of the bristles being embedded in a bead 48. The bead 48 serves to hold the bristles in a predetermined side-by-side arrangement. The bead 48 engages the holder E as shown in FIG. 3, which holder has an end portion of greater area than the first port 22, and the holder E when in a first position being in sealing contact with the lip 20. The spring F which is of helical configuration and deformed, has one end in abutting contact with the holder E and the other end in contact with the truncated apex 36 of the second inner housing C. Spring F at all times tends to maintain the first brush D in a first position in which the holder E is in sealing engagement with the lip 20 to obstruct communication between the ambient atmosphere and the interior of the accessory A through the first port 22. Each of the second brushes G includes a second body of bristles 50 that have first free ends 52, and the second ends of the bristles being embedded in a second bead 54 formed a resilient material. Each of the beads 54 can be forced through one of the apertures 42 to hold one of the brushes G on one of the tabs 40 as illustrated in FIG. 3, with each brush extending outwardly through one of the second ports 24.

The vacuum cleaner accessory A may be removably mounted on the free end of a pliable vacuum cleaner hose H by inserting the free end thereof within the confines of the first cylindrical shell 10 as illustrated in FIG. 3. The vacuum cleaner accessory A may be removably secured to the free end portion of the hose H by an adaptor J as shown in FIG. 4. The adaptor J includes a tubular member 56 having a first end 58 and a second end 60. The second end 60 of member 56 develops into an inwardly extending lip 62. The lip 62 supports a number of circumferentially spaced outwardly tapering fingers 64 that are axially aligned with the tubular member 56. Each of the fingers 64 has a stop 66 on the outer extremity thereof. A ring 68 is provided that is slidably movable on the finger 64, with the ring having a tapered interior surface 70. When the free end portion of the hose H is situated within the confines of the fingers 64, the ring 68 is moved outwardly, and due to the tapered surface 70 the fingers are forced into frictional gripping contact with the exterior surface of the free end portion of the hose H. The tubular member 56 is slidably mounted on the exterior surface of the first cylindrical shell 10 and removably supported thereon due to frictional contact between the tubular member 56 and the first shell 10.

The use and operation of the invention A is extremely simple. The vacuum cleaner (not shown) when operating impresses a negative pressure within the hose H, but not of sufficient magnitude as to cause the tabs 40 to move inwardly to second positions. When one of the second brushes G contacts a surface K on which dirt or dust L may be located as shown in FIG. 3, the brush is sufficiently rigid as to pivot the tab 40 with which it is associated into a second position, and allow a stream of air to move inwardly through one of the second ports 24 at high velocity, as illustrated by the arrows in FIG. 3, and due to this high velocity inwardly moving stream of air, the dust and dirt L that has been dislodged from the surface K by rubbing contact with the second brushes G is carried into the interior of the invention. The dust or dirt so retrieved is subsequently carried through the hose H to the vacuum cleaner (not shown). All of the tabs 40 normally tend to remain in first positions, and only those tabs that have second brushes G mounted thereon that contact the surface K move to the second position. Thus, the flow of air from the ambient atmosphere into the interior of the invention is at the most through only a few of the second ports 24 and as a result the streams of air flowing into the invention are at a substantially higher velocity than if all of the second ports 24 were open. Due to the high velocity of the streams of air flowing into the invention A through only a few ports, substantially all dirt and dust L dislodged from the surface K will be retrieved and carried into the interior of the invention A. The first brush D is particularly useful in retrieving dust or dirt from a corner or other restricted area, and the brush D when brought into the surface defining such a corner is moved inwardly by pressure contact therewith to dispose the brush holder E and brush D in a second position where air and high velocity may flow to the first port 22 to carry dislodged dust and dirt L therewith. From the previous description, it will be apparent that the first and second ports 22 and 24 are at all times sealed, except when the vacuum cleaner is operating, and a portion of the first and second brushes D and G are brought into pressure rubbing contact with a surface K.

The use and operation of the invention has been described previously in detail, and need not be repeated.

I claim:

1. In combination with a power driven vacuum cleaner having a flexible hose extending therefrom that has a first free end and in which hose a negative pressure is maintained, a combined dirt and dust loosening and retrieving device removably mounted on said free end of said hose, said device including:

a. a first housing that includes a first cylindrical shell having first and second ends, said first end developing into a first conical shell that has an apex in which a first port is defined, said first conical shell having a plurality of circumferentially and longitudinally spaced second ports therein, said first cylindrical shell having a transverse circumferential resilient rib extending inwardly from the interior surface thereof, and said rib situated intermediate said first and second ends of said first cylindrical shell;

b. a second housing molded from a resilient polymerized resin, said second housing including a second cylindrical shell that has first and second ends, said first end of said second shell developing into a second conical shell that has a truncated apex portion, said second conical shell having a plurality of circumferentially and longitudinally spaced U-shaped slits formed therein that define resilient tabs within the confines thereof, said tabs of greater area than that of said second ports, said second housing of such dimensions as to fit snugly within said first housing and being held in a fixed position therein by said rib engaging said first end of said second cylindrical shell, and said tabs being radially aligned with said second ports in said first conical shell and sealing said second ports when said tabs are in first positions;

c. a spring loaded sealing member disposed between the apex portions of said first and second conical shells, said sealing member at all times tending to assume a first position where it seals said first port in said first conical shell;

d. a first brush secured to said sealing member which first brush extends outwardly through said first port; and e. a plurality of second brushes secured to said tabs and extending outwardly through said second ports, said first and second brushes sufficiently stiff as to move said spring loaded sealing member and said tabs with which they are associated to second positions when said first and second brushes are brought into pressure rubbing contact with a surface on which dust or dirt may exist, said rubbing contact tending to loosen said dust or dirt, and said sealing member and tabs when in said second positions allowing streams of velocity air to flow from the ambient atmosphere into the interior of said second housing, and said streams of air carrying said dust or dirt that has been loosened into the interior of said second housing for subsequent transfer through said hose to said vacuum cleaner.

2. A device as defined in claim 1 in which each of said tabs have an aperture therein radially aligned with one of said second ports, and each of said second brushes including;

f. a body of bristles disposed side-by-side, said body including first and second ends; and g. a resilient bead secured to said bristle body first end, said bead of such size as to be forced through one of said apertures to support said body of bristles with which it is associated on one of said tabs, and said body extending outwardly through one of said ports.

* * * * *